US005794364A

United States Patent [19]

Richmond

[11] Patent Number: 5,794,364

[45] Date of Patent: Aug. 18, 1998

[54] PROJECTILE LAUNCHING AND RECIRCULATING DISPLAY APPARATUS AND METHOD OF DISPLAYING SAME

[76] Inventor: Randel William Richmond, 635 S. Hampton Ave., Orlando, Fla. 32803

[21] Appl. No.: 732,839

[22] Filed: Oct. 15, 1996

[51] Int. Cl.[6] ..... G09F 19/00

[52] U.S. Cl. ..... 40/406; 40/409; 446/176; 446/179

[58] Field of Search ..... 40/406, 407, 409; 446/176, 179

[56] References Cited

U.S. PATENT DOCUMENTS

| | | | |
|---|---|---|---|
| Re. 13,875 | 2/1915 | Rotherham . | |
| 1,768,409 | 6/1930 | Kuczorra | 40/407 X |
| 2,361,346 | 10/1944 | Atkins . | |
| 2,464,460 | 3/1949 | Pack . | |
| 2,785,895 | 3/1957 | Neveling, Sr. . | |
| 2,911,745 | 11/1959 | Simon . | |
| 3,415,513 | 12/1968 | Burnbaum . | |
| 4,215,500 | 8/1980 | Sharp . | |
| 4,757,625 | 7/1988 | Watkins | 40/406 |
| 5,314,368 | 5/1994 | Cheng . | |
| 5,426,877 | 6/1995 | Lin . | |

FOREIGN PATENT DOCUMENTS

| | | | |
|---|---|---|---|
| 139230 | 12/1948 | Australia . | |
| 270765 | 12/1930 | Italy . | |
| 179007 | 5/1922 | United Kingdom | 40/407 |
| 526761 | 9/1940 | United Kingdom | 40/406 |
| 701037 | 12/1953 | United Kingdom . | |
| 2249858 | 5/1992 | United Kingdom | 40/410 |

*Primary Examiner*—Kenneth J. Dorner
*Assistant Examiner*—Andrea Chop

[57] ABSTRACT

A projectile launching and recirculating display apparatus and method are provided which preferably include a collector extending in a generally horizontal plane, and having an opening positioned in a medial portion thereof for collecting a plurality of projectiles, such as balloons, therein. A blower has an output positioned to underlie the collector opening for blowing a gas upwardly through the opening and thereby blowing the plurality of projectiles upwardly when overlying the collector opening. An elongate, vertically-extending chute has a lower end thereof positioned to overlie and be spaced-apart from the collector opening and the output of the blower and an upper end extending upwardly therefrom so that the plurality of projectiles overlying the collector opening and the output of the blower are projected upwardly into the lower end of the chute, through the chute, outwardly from the upper end of the chute, and outwardly from the path of the blowing gas for collecting by the collector after falling downwardly from the upper end of the chute to be recirculated to the lower end of the chute to thereby provide a continuous projectile cascading-type appearance.

21 Claims, 3 Drawing Sheets

PROJECTILE LAUNCHING AND RECIRCULATING DISPLAY APPARATUS AND METHOD OF DISPLAYING SAME

FIELD OF INVENTION

This invention is related to entertainment, novelty, party, meeting, private and public gatherings, and convention services industries and, more particularly, to a display apparatus and a method of festively displaying items for these industries.

BACKGROUND OF THE INVENTION

Display devices or systems have been developed over the years for various industries. Some of these display devices have included displaying projectiles such as popcorn, balls, balloons, and spangles. Examples of some of these display devices can be seen in U.S. Reissue Pat. No. 13,875 by Rotherham, U.S. Pat. No. 3,415,513 by Burnbaum, U.S. Pat. No. 4,215,500 by Sharp, United Kingdom published patent application number 701,037 by Lake et al., and Australian published patent application number 139,230. Some of these display devices have been for the purposes of increasing sales of the actual displayed item such as popcorn. Others have been used as toys or games. The prior projectile display devices, however, often only suspend a projectile in the air, or only projects the projectile upwards or drops it downwards in a closed-ended container which reduces interest, festiveness, and attractiveness of the display device.

Therefore, a need continues to exist for festive, creative, and attractive displays such as for convention, party, meeting, and various private and public gathering decorations, for room presentations, and for passive entertainment.

OBJECTS AND SUMMARY OF THE INVENTION

With the foregoing in mind, it is an object of the present invention to provide a festive, creative, and attractive projectile display apparatus and method of displaying projectiles for conventions, parties, and various private and public gatherings.

It is also an object of the present invention to provide a projectile display apparatus and method that recirculates projectiles through the apparatus after being initially launched.

It is an additional object of the present invention to provide a balloon display apparatus and method that provides a festive and entertaining display for conventions, parties, and various private and public gatherings and that is readily portable for transporting and installing at these various events.

It is still another object of the present invention to provide a balloon display apparatus and method that has a fountain-type display appearance.

It is a further object of the present invention to provide a balloon display apparatus and method that allows balloons to be projected or launched outwardly from a core or chute to provide an outwardly spraying-type appearance such as seen in a water fountain and readily recirculate after being initially projected.

More particularly, a projectile display apparatus according to the present invention preferably includes at least a collector which preferably extends in a generally horizontal plane and has an opening positioned in a medial portion thereof for collecting a plurality of projectiles, such as balloons or lightweight balls, therein. Launching means, e.g. a blower, has an output positioned to underlie the collector opening for launching the plurality of projectiles upwardly through the opening and thereby blowing the plurality of projectiles upwardly when overlying the collector opening so that the plurality of projectiles overlying the collector opening and the output of the launching means are projected upwardly for collecting by the collector after falling downwardly therefrom so as to be recirculated to the collector opening and the launching means to thereby provide a projectile cascading-type or fountain-type appearance.

The apparatus according to the present invention preferably also includes a vertically-extending chute having a lower end thereof positioned to overlie and be spaced-apart from the collector opening and the output of the launching means and an upper end extending upwardly therefrom so that the plurality of projectiles overlying the collector opening and the output of the launching means advantageously are projected upwardly into the lower end of the chute, through the chute, and outwardly from the upper end of the chute for collecting by the collector after falling downwardly from the upper end of the chute to be recirculated to the lower end of the chute to thereby provide the projectile cascading-type or fountain-type appearance.

Because a projectile collector preferably has a smooth upper surface and a concave recess, circular, orb, oval, and other generally round-shaped projectiles that readily move or roll advantageously flow downwardly to the opening to be launched or projected upwardly through the chute. The projectile launching and recirculating apparatus also can advantageously include static inhibiting means positioned below, above, on, or integrally formed with the projectile collector for inhibiting the accumulation of static energy on the upper surface of the projectile collector so that balloons, lightweight balls, and the like readily roll to the blower for launching through the chute.

The present invention also includes methods of displaying projectiles such as balloons or lightweight balls. The method preferably includes positioning a plurality of projectiles on a projectile collector and projecting the plurality of projectiles upwardly such as through a chute. The plurality of projectiles are collected after floating downwardly from the upwardly projected position. The plurality of projectiles are recirculated to thereby provide a continuous projectile cascading-type or fountain-type appearance.

The cascading-type or fountain-type appearance and the downward rolling of the projectiles along the upper surface of the projectile collector advantageously provide a display apparatus and method that is festive, colorful, creative, and entertaining. The apparatus and method provide a quiet and passive display that adds to the festive environment such as desired at weddings, graduation ceremonies, proms or other dances, business gatherings, and public events. Because the various elements of the apparatus, e.g., projectile collector, projectiles, cover, chute, and stand, are portable, can easily be formed of various colors, include various logos, slogans, prints, or patterns thereon, and can be arranged in various configurations which still provide the essence of the present invention, the apparatus can be easily customized to fit the particular type of gathering desired.

BRIEF DESCRIPTION OF THE DRAWINGS

Some of the objects and advantages of the present invention having been stated, others will become apparent the description proceeds when taken in conjunct the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
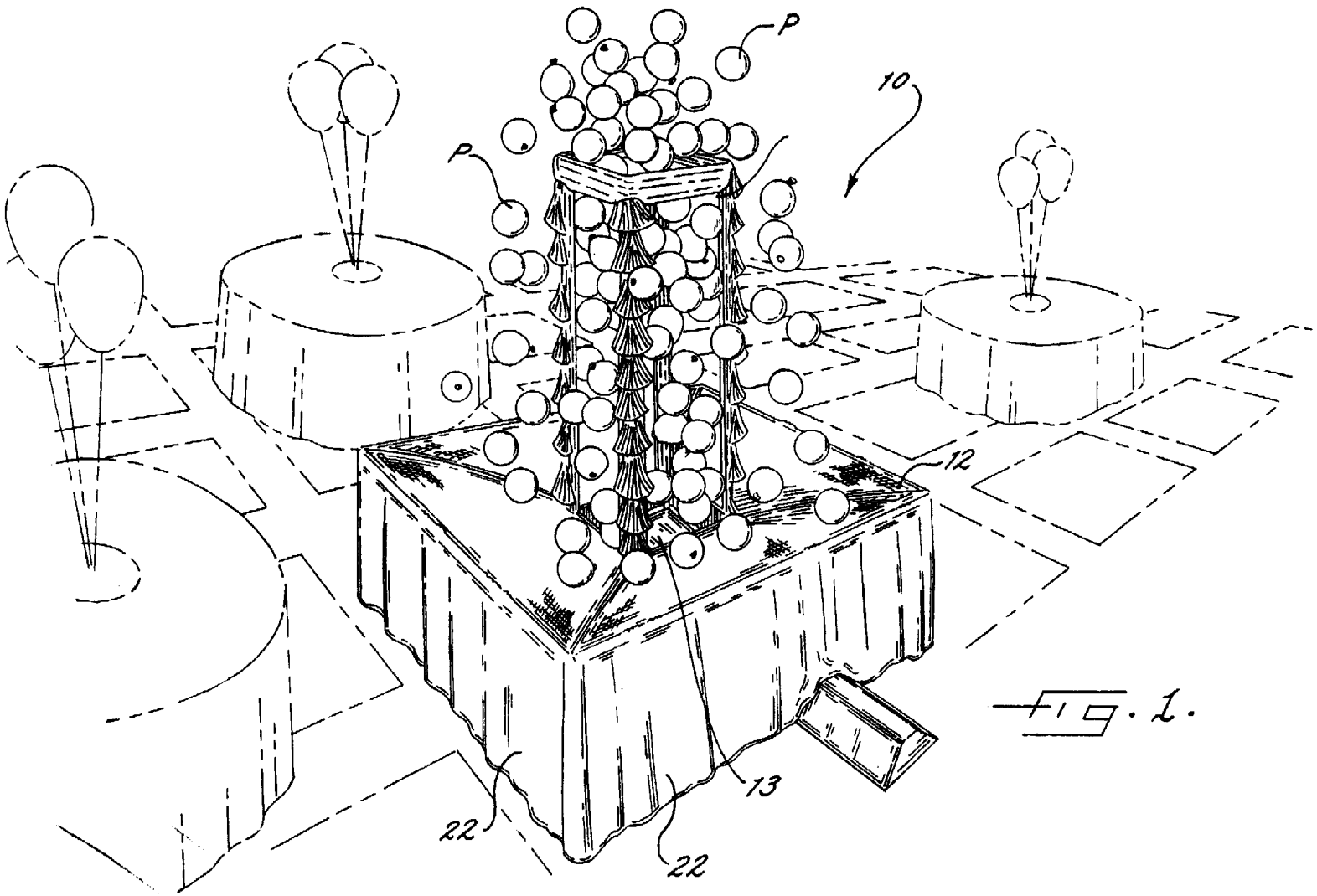
FIG. 1 is an environmental view of a projectile blowing apparatus according to the present invention.
Figures 2, 3:
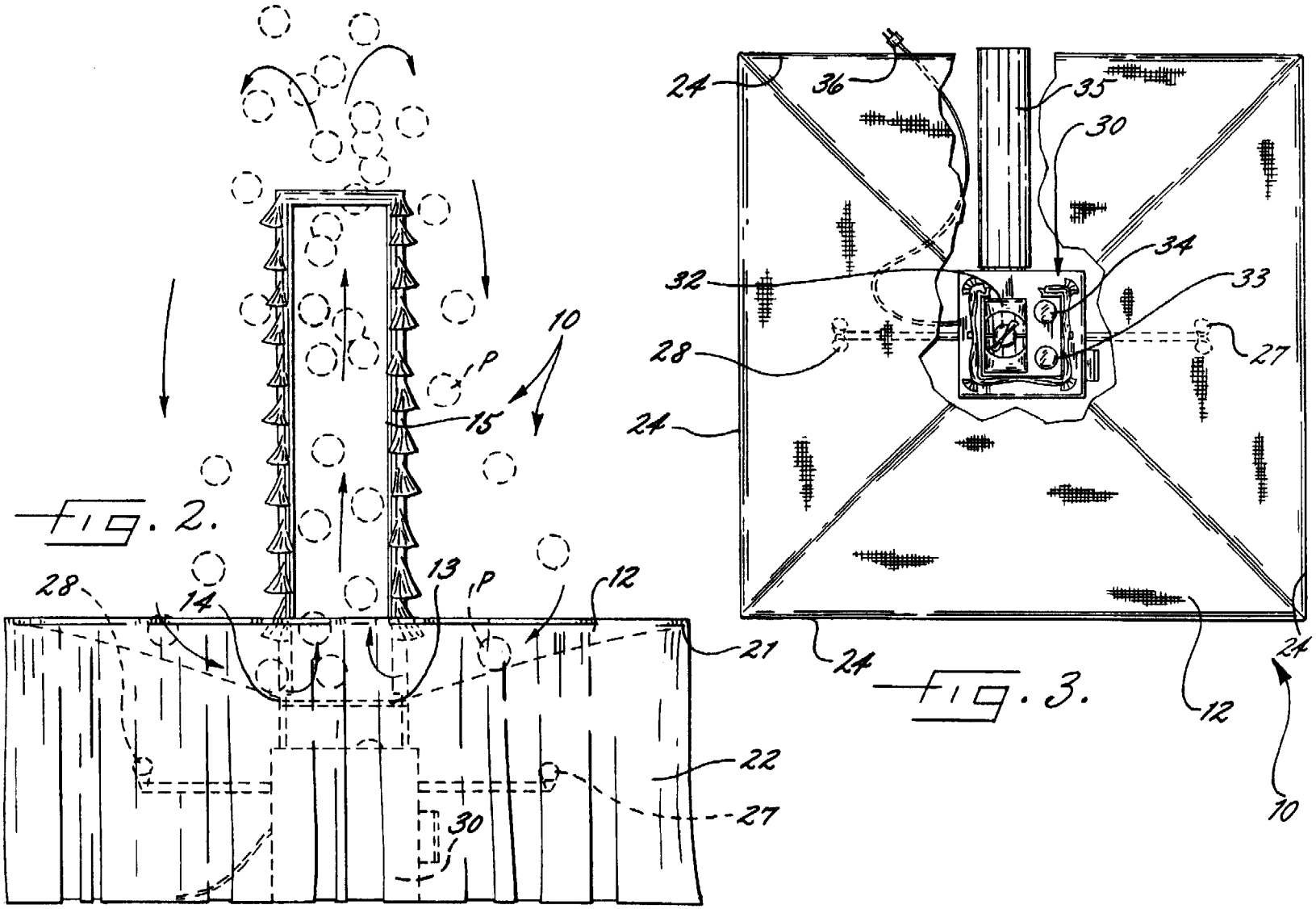
FIG. 2 is a front elevational view of a projectile blowing apparatus according to the present invention.
FIG. 3 is a top plan view of a projectile blowing apparatus with a portion broken away for clarity according to the present invention.

FIGS. 1–2 illustrate a projectile launching and recirculating display apparatus 10 according to the present invention. The projectile launching and recirculating display apparatus 10, more particularly, is illustrated in the form of a balloon launching and recirculating display apparatus for launching and recirculating a plurality of balloons P. The apparatus 10 preferably includes projectile recirculating means 12, e.g., a projectile collector, extending in a generally horizontal plane, having a smooth upper surface, and having an opening 13 positioned in a medial portion thereof for collecting and recirculating a plurality of projectiles P, such as balloons, lightweight balls, or other projectiles which preferably have a circular, oval, orb, or other generally round shape. These shaped projectiles P preferably roll toward the collector opening 13 when positioned therein. The projectile collector 12 (e.g., a balloon collector) preferably has a concave recess 14 and in which the collector opening 13 is positioned at a lower end of the recess 14.

As understood by those skilled in the art, the recirculating means 12 can be of various shapes, sizes, and configurations which collect and provide a recirculation path for the projectiles, but having outer and upper peripheries raise or at a higher elevation than inner lower ends, e.g., downwardly sloping from an upper end to a lower end, is preferable to advantageously enhance the collecting and downward rolling motion of the projectiles P as illustrated. Having the recirculation means 12 extend outwardly in the horizontal plane also advantageously provides a pool or pond type appearance such used with water fountains to gather and recirculate water.

The projectile collector 12 is preferably formed of a fabric material which is relatively inexpensive, portable, and based on various fabric colors, prints, and patterns, for example, can readily adapt to various festive and party environments, e.g., weddings, proms, graduation ceremonies, dances, and business gatherings. The fabric material also advantageously can be easily cleaned and pressed for reuse during various occasions. Because the projectile collector 12 preferably has a smooth upper surface and a concave recess, circular, orb, oval, and other generally round shaped projectiles P that readily roll advantageously flow downwardly to the opening to be launched or projected upwardly through the chute 15. It will also be understood by those skilled in the art that other materials such as plastics, foam, fiberglass, lightweight metals, and combinations thereof can be used as well for the projectile collector 12 according to the present invention.

Additionally, as best illustrated in FIG. 2, the apparatus 10 preferably has a frame 21 formed of metal or wood frame support members supporting the projectile collector 12 and a cover 22, e.g., preferably formed of fabric material as well, detachably connected to and surround side members 24 of the frame 21. Various festive decorations besides the cover 22, or instead of the cover 22, can be used as well for particular events. The frame 21, for example, can have a rectangular, circular, or hexagonal shape as illustrated or, alternatively, and as understood by those skilled in the art, can advantageously be shaped and configured to conform to various environmental settings in which the shape of the projectile collector 12 and its supporting structure would be most desired.

As also illustrated in FIGS. 2–3, a portable projectile control console 30 preferably underlies the opening 13 in the projectile collector 12 and is positioned to be covered by the cover 22 when connected to the frame 21. For portability and ready set-up, the portable projectile control console 30 preferably includes launching means, e.g., a blower or a fan 32, having an output positioned to underlie the collector opening for launching, e.g., blowing air or a gas, projectiles P upwardly through the opening 13 and thereby launching, e.g., blowing, the plurality of projectiles P upwardly when overlying the collector opening 13. Advantageously, a blower 32 such as a fan can readily be purchased, is portable, can operate quietly and continuously, the air or gas output can be easily controlled, and is relatively inexpensive. It will be understood by those skilled in the art, however, that other launching devices, including projectile contact launchers, e.g., ball and spring launchers, can be used as well according to the present invention.

An apparatus according to the present invention advantageously can further include an elongate and vertically-extending chute 15 having a lower end positioned to overlie and be spaced-apart from the collector opening 13 of the collector 12 and the output of launching means, e.g., a blower 32, and un upper end extending upwardly therefrom. The chute 15 can be formed of a plastic, glass, paper, or metal material, but preferably provides a path for upward launching of the projectiles P. As best illustrated in FIGS. 1–2, the chute 15 advantageously can be decorated with various paper, fabric, plastic, or other festive decorations for adding to the appearance for the gathering. The plurality of projectiles P, e.g., balloons, which then overlie the collector opening 13 and the output of the blower 32 are projected upwardly into the lower end of the chute 15, through the chute 15, outwardly from the upper end of the chute 15, and outwardly from the path of the blowing gas. The projectile collector 12 then collects the projectiles P after falling downwardly from the upper end of the chute 15. Balloons can advantageously be used as the projectiles P because they float both upwardly away from the chute and downwardly to the projectile collector 12. The projectiles P are then recirculated to the lower end of the chute 15 to thereby provide a projectile cascading-type or fountain-type appearance as best illustrated in FIG. 1.

The portable console 30 also preferably includes first illuminating means, e.g., at least one and preferably a plurality of lights 33, 34, positioned adjacent the blower 32 and underlying the opening 13 in the projectile collector 12 for illuminating the chute to enhance visual appearance of the apparatus 10 when positioned in low ambient light environments. Although incandescent-type lights are preferable because they are relatively inexpensive, can be purchased in a variety of colors and sizes, and can be readily replaced, it will be understood by those skilled in the art that other types of lights such as lasers, light emitting diode arrays, electroluminescent arrays, and the like can be used as well. The portable console 30 preferably has a power source or power supply 36, 36' positioned therein for detachably connecting to an external power source or power supply where the projectile launching and recirculating display apparatus 10 is located. The blower 32 also preferably includes an air or gas input source connected to a proximal end of an elongate tube 35 which has a distal end extending outwardly from the console 30 and under or through the cover 22 of the frame 21.

Second illuminating means, e.g., at least one and preferably a plurality of lights 27, 28, is positioned to underlie the projectile collector 12 for illuminating the collector 12 to enhance the visual appearance when positioned in low ambient light environments. These lights 27, 28 also advantageously can be of various colors and can also illuminate various patterns, logos, names, or slogans on the overlying projectile collector 12 to thereby create themes or appearances tailored for various occasions. These lights 27, 28 can alternatively also illuminate the cover 22 which can also illuminate various patterns, logos, names, or slogans on the cover 22 for similar purposes. Like the first illuminating means, although incandescent-type lights are preferable because they are relatively inexpensive, can be purchased in a variety of colors and sizes, and can be readily replaced, it also will be understood by those skilled in the art that other types of lights such as lasers, light emitting diode arrays, electroluminescent arrays, and the like can be used as well.

Figure 5:
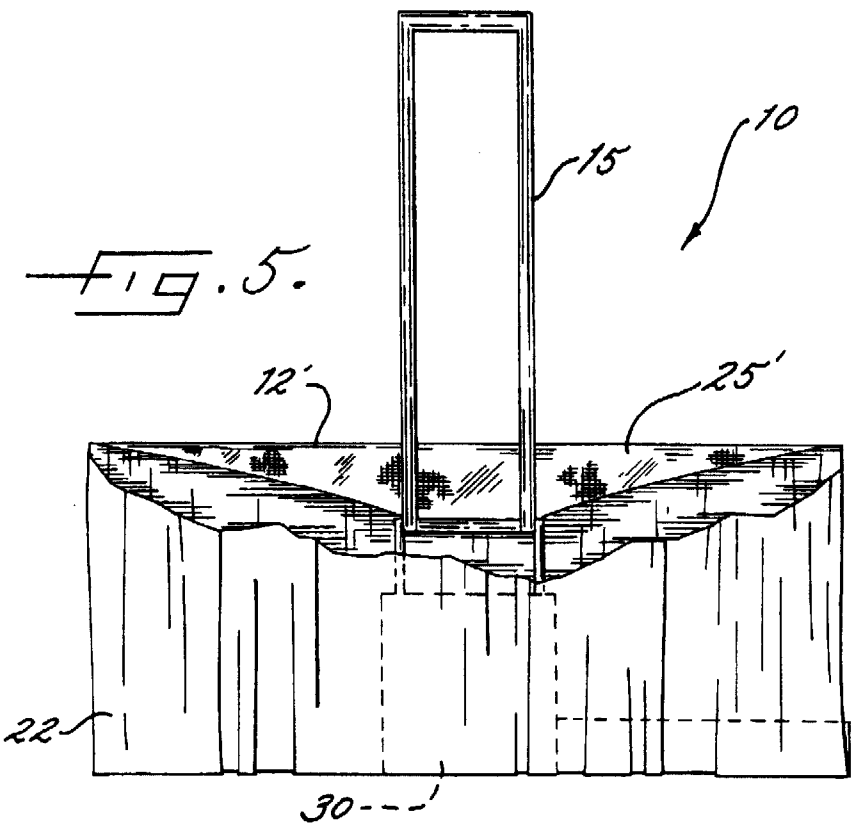
FIG. 5 is a fragmentary side elevational view of a projectile blowing apparatus including a second embodiment of a projectile collector and static inhibitor according to the present invention.
Figure 4:
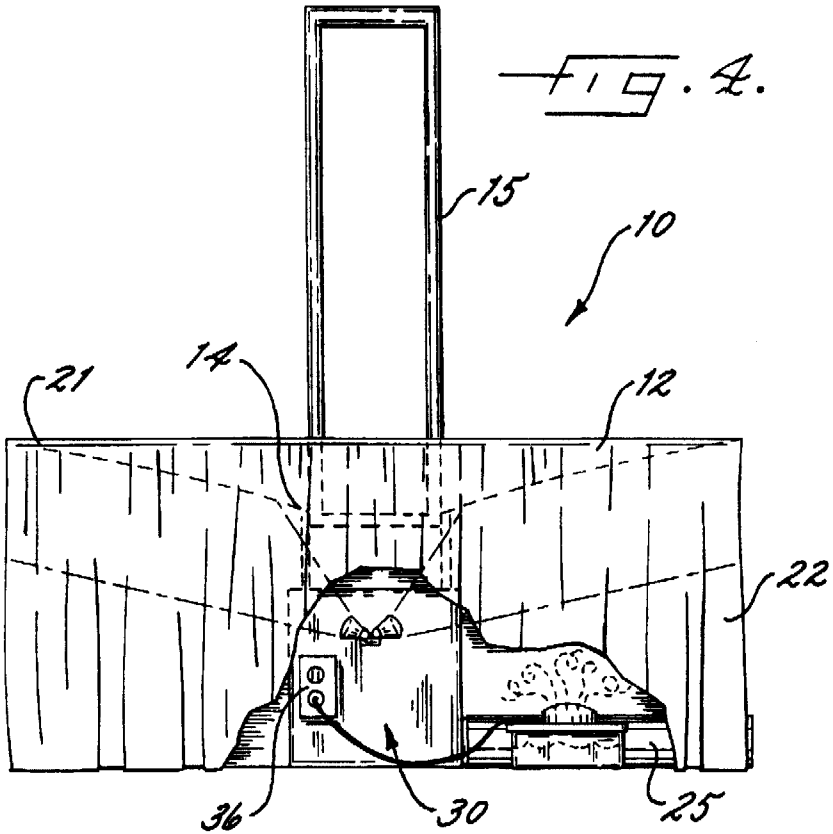
FIG. 4 is a fragmentary side elevational view of a projectile blowing apparatus including a first embodiment of a projectile collector and static inhibitor according to the present invention.

The projectile launching and recirculating apparatus 10 according to the present invention, as best illustrated in FIGS. 4–5, advantageously can further include static inhibiting means, e.g., a static inhibitor 25, underlying the projectile collector 12 for inhibiting static energy from accumulating on the projectile collector 12 to enhance the recirculation of the plurality of projectiles P. The output of the static inhibitor 25 preferably contacts the balloons or the upper surface of the projectile collector 12. This first embodiment of a static inhibitor 25 is preferably a humidifier, another device that provides dampness to the fabric projectile collector 12, or other devices that inhibit static energy or the like which then inhibits the downwardly rolling or continuous flow of the projectiles P, e.g., balloons. This embodiment of the static inhibitor 25 also advantageously can reduce wrinkles and the like in the fabric of a projectile collector 12.

Alternatively, the static inhibiting means 25' can overlie, be positioned on, or be integrally formed with the projectile collector 12 for inhibiting static energy from accumulating on the projectile collector 12 to enhance the recirculation of the plurality of projectiles P. This second embodiment, for example, can be fabric forming the projectile collector 12' which is sprayed or treated with a static inhibiting formula, e.g., fabric softener, or fabric, fibers, or other materials which form the projectile collector 12 treated or integrally formed with static inhibiting agents. It can also be a humidifier positioned to overlie the projectile collector 12 and which is hidden from view such as surrounding the upper peripheries of the projectile collector 12.

As illustrated in FIGS. 1–5, the present invention also includes methods of displaying projectiles P such as balloons or lightweight balls. The method preferably includes positioning a plurality of projectiles P on a projectile collector 12 and projecting the plurality of projectiles P upwardly through a vertically-extending chute 15. The plurality of projectiles P discharged from the chute 15 are collected after floating downwardly from the upper end of the chute 15. The plurality of projectiles P are then recirculated through the chute 15 to thereby provide a projectile cascading-type or fountain-type appearance as best illustrated in FIG. 1.

The method preferably also includes inhibiting static energy from accumulating on the projectile collector 12 to thereby allow the plurality of projectiles P to readily recirculate through the chute 15. The vertically extending chute 15 can also be illuminated, e.g., by a plurality of lights 33, 34, to thereby enhance the visual appearance of the upwardly projected plurality of projectiles P when positioned in low ambient light environments.

The method can further include positioning a portable console 30 including a blower 32 and at least one light 33, 34 so as to underlie an opening formed in the projectile collector 12 for launching, e.g., blowingly projecting, the plurality of projectiles P upwardly through the chute 15 and for illuminating the chute 15. The projectile collector 12 can also be illuminated to thereby enhance the visual appearance of the recirculated plurality of projectiles P.

The cascading-type or fountain-type appearance and the downward rolling of the projectiles P along the upper surface of the projectile collector 12 advantageously provide a display apparatus 10 and method that is festive, colorful, creative, and entertaining. Additionally, balloons advantageously can be used as the projectiles to provide a floating or airy appearance as the balloons are pulled by gravity toward the projectile collector 12 after being launched through the chute 15. This type of appearance further enhances the desired festive and entertaining uses. The projectile launching and recirculating display apparatus 10 and method provide a quiet and passive display that adds to the festive environment such as desired at weddings, graduation ceremonies, proms or other dances, business gatherings, and public events. Because the various elements of the apparatus 10, e.g., projectile collector 12, projectiles P, cover 22, chute 12, and frame or stand 21, are portable, can easily be formed of various colors, include various logos, slogans, prints, or patterns thereon, and can be arranged in various configurations which still provide the essence of the present invention, the apparatus 10 can be easily customized to fit the particular type of gathering desired.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A balloon launching and recirculating display apparatus comprising:

a plurality of balloons;

a balloon collector extending in a generally horizontal plane, said balloon collector having an open upper end positioned to collect the plurality of balloons therein, a relatively smooth upper surface sloping downwardly from the open upper end to a lower end portion for facilitating downward rolling of the plurality of balloons, and an opening positioned in the lower end portion;

a blower having an output positioned to underlie the collector opening for blowing a gas upwardly through the opening and thereby blowing the plurality of balloons upwardly when overlying the collector opening;

an elongate, vertically-extending chute having a lower end positioned to overlie and be spaced-apart from the collector opening and the output of the blower and an upper end extending upwardly therefrom so that the plurality of balloons overlying the collector opening and the output of the blower are projected upwardly into the lower end of said chute, through said chute, outwardly from the upper end of said chute, and outwardly from the path of the blowing gas to be collected by said balloon collector after falling downwardly from the upper end of said chute to be recirculated to the lower end of said chute to thereby provide a continuous balloon cascading-type appearance;

static inhibiting means cooperating with said balloon collector for inhibiting static energy from accumulating on said balloon collector to enhance the recirculation of the plurality of balloons; and at least one light directly underlying said balloon collector opening and aligned with said chute and positioned adjacent said blower for illuminating said chute so that when the plurality of balloons are blown upwardly through said chute the visual appearance is enhanced when the apparatus is positioned in low ambient environments.

2. A balloon launching and recirculating display apparatus as defined by claim 1, wherein said balloon collector has a concave recess including the collector opening positioned at a lower end of said recess.

3. A balloon launching and recirculating display apparatus as defined by claim 1, wherein said static inhibiting means underlies said balloon collector for inhibiting static energy from accumulating on said balloon collector to enhance the recirculation of the plurality of balloons.

4. A balloon launching and recirculating display apparatus as defined by claim 1, wherein said static inhibiting means overlies said balloon collector for inhibiting static energy from accumulating on said balloon collector to enhance the recirculation of the plurality of balloons.

5. A balloon launching and recirculating display apparatus as defined in claim 1, wherein said light defines a first illuminating means and wherein the apparatus further comprises second illuminating means positioned to underlie said balloon collector for illuminating said collector to enhance the visual appearance when positioned in low ambient environments.

6. A balloon launching and recirculating display apparatus as defined in claim 5, wherein said balloon collector is formed of a fabric material.

7. A balloon launching and recirculating display apparatus as defined in claim 6, further comprising a frame underlying and supporting said fabric balloon collector and a frame cover connected to and surrounding sides of said frame.

8. A balloon launching and recirculating display apparatus as defined in claim 1, further comprising a portable projectile control console underlying the opening in said balloon collector for ready addition to or removal therefrom, and wherein said portable projectile control console includes a housing, said blower positioned in said housing, the at least one light positioned in said housing and adjacent said blower for illuminating said chute to enhance visual appearance when positioned in a low ambient environment, and a power source connected to said housing and adapted to connect an external power supply thereto for supplying power to said blower and the at least one light.

9. A balloon launching and recirculating display apparatus as defined in claim 1, wherein said static inhibiting means is positioned on said balloon collector for inhibiting static energy from accumulating on said balloon collector to thereby allow said plurality of balloons to readily recirculate through said chute.

10. A balloon launching and recirculating display apparatus comprising:

a plurality of balloons;

a balloon collector extending in a generally horizontal plane and having an opening positioned in a lower end portion thereof to collect the plurality of balloons therein;

launching means having an output positioned to underlie the balloon collector opening for launching the plurality of balloons upwardly through the balloon collector opening when overlying the balloon collector opening;

a vertically-extending chute having a lower end positioned to overlie and be spaced-apart from the balloon collector opening and the output of said launching means and an upper end extending upwardly therefrom so that the plurality of balloons overlying the balloon collector opening and the output of the launching means are projected upwardly into the lower end of said chute, through said chute, and outwardly from the upper end of said chute for collecting by said balloon collector after falling downwardly from the upper end of said chute to be recirculated to the lower end of said chute to thereby provide a continuous balloon cascading-type appearance;

static inhibiting means cooperating with said balloon collector for inhibiting static energy from accumulating on said balloon collector to enhance the recirculation of the plurality of balloons; and at least one light directly underlying said balloon collector opening and aligned with said chute and positioned adjacent said launching means for illuminating said chute so that when the plurality of balloons are launched upwardly through said chute the visual appearance is enhanced when the apparatus is positioned in low ambient environments.

11. A balloon launching and recirculating display apparatus as defined by claim 10, wherein said collector has a concave recess including the collector opening positioned at a lower end of said recess.

12. A balloon launching and recirculating display apparatus as defined by claim 11, wherein said static inhibiting means underlies said collector for inhibiting static energy from accumulating on said collector to enhance the recirculation of the plurality of balloons.

13. A balloon launching and recirculating display apparatus as defined by claim 11, wherein said static inhibiting means overlies said collector for inhibiting static energy from accumulating on said collector to enhance the recirculation of the plurality of balloons.

14. A balloon launching and recirculating display apparatus as defined in claim 11, wherein said static inhibiting means is positioned on said projectile collector for inhibiting static energy from accumulating on said collector to thereby allow said plurality of projectiles to readily recirculate through said chute.

15. A balloon launching and recirculating display apparatus as defined in claim 10, wherein said light defines a first illuminating means and wherein the apparatus further comprises second illuminating means positioned to underlie said balloon collector for illuminating said balloon collector to enhance the visual appearance when positioned in low ambient environments.

16. A balloon launching and recirculating display apparatus as defined in claim 15, wherein said collect or is formed of a fabric material.

17. A balloon launching and recirculating display apparatus as defined in claim 16, further comprising a frame underlying and supporting said fabric collector and a frame cover connected to and surrounding sides of said frame.

18. A balloon launching and recirculating display apparatus as defined in claim 17, further comprising a portable projectile control console underlying the opening in said balloon collector for ready addition to or removal therefrom, and wherein said portable projectile control console includes a housing, said launching means positioned in said housing, the at least one light positioned in said housing and adjacent said launching means for illuminating said chute to enhance visual appearance when positioned in a low ambient environment, and a power source connected to said housing and adapted to connect an external power supply thereto for supplying power to said launching means and the at least one light.

19. A method of displaying balloons comprising:

positioning a plurality of balloons on a balloon collector having an opening formed in a lower portion thereof;

projecting the plurality of balloons overlying the balloon collector opening upwardly through a chute with a blower having an output underlying the balloon collector opening;

collecting the plurality of balloons after floating downwardly from an upward position so as to travel toward the balloon collector opening;

recirculating the plurality of balloons to thereby provide a continuous balloon cascading-type appearance;

inhibiting the static energy from accumulating on the balloon collector to thereby allow the plurality of balloons to readily travel and recirculate thereon; and illuminating the chute during upward projection of the balloons by a light source directly underlying the collector opening and aligned with the chute to thereby enhance the visual appearance when position in low ambient environments.

20. A method as defined in claim 19, further comprising positioning a portable console including a blower and lights so as to underlie an opening formed in the balloon collector for blowingly projecting the plurality of balloons upwardly and for illuminating the upwardly projected balloons.

21. A method as defined in claim 20, further comprising illuminating the balloon collector to thereby enhance the visual appearance of the recirculated plurality of balloons when positioned in low ambient light environments.

* * * * *